US006170967B1

(12) United States Patent
Usher et al.

(10) Patent No.: US 6,170,967 B1
(45) Date of Patent: Jan. 9, 2001

(54) MINIATURE LIGHTING APPARATUS

(76) Inventors: Scott Usher, 98 Copley Ave., Teaneck, NJ (US) 07666; Terrence C. Walsh, 2 Whitehall, Coto de Caza, CA (US) 92679

( * ) Notice: Under 35 U.S.C. 154(b), the term of this patent shall be extended for 0 days.

(21) Appl. No.: 08/259,385

(22) Filed: Jun. 14, 1994

(51) Int. Cl.[7] ..... F21V 21/14

(52) U.S. Cl. ..... 362/394; 362/427; 362/404; 362/226; 362/287; 439/17; 200/227; 200/51.07

(58) Field of Search ..... 362/404, 394, 362/269, 427, 227, 287, 802, 226, 238, 239, 276, 408, 147, 274; 200/61.51, 61.52, 51.07, 51.12, 277; 439/110, 117, 207, 6, 13, 17, 19

(56) References Cited

U.S. PATENT DOCUMENTS

| | | | | |
|---|---|---|---|---|
| 3,341,803 | | 9/1967 | Bustamante . | |
| 3,718,816 | * | 2/1973 | Seclbach et al. | 362/394 |
| 4,144,429 | * | 3/1979 | Ascoli | 200/51.07 |
| 4,364,104 | * | 12/1982 | Holahan et al. | 362/802 X |
| 4,751,627 | | 6/1988 | Usher . | |
| 4,979,081 | | 12/1990 | Leach et al. . | |
| 5,072,216 | * | 12/1991 | Grange | 362/802 X |
| 5,142,460 | * | 8/1992 | McAtee | 362/394 X |
| 5,359,501 | * | 10/1994 | Stevens | 362/802 X |

FOREIGN PATENT DOCUMENTS

| | | |
|---|---|---|
| 0188736 | 12/1985 | (EP) . |
| 381354 | 10/1932 | (GB) . |
| 9011471 | 10/1990 | (WO) . |

* cited by examiner

*Primary Examiner*—Thomas M. Sember
(74) *Attorney, Agent, or Firm*—Arthur Jacob

(57) ABSTRACT

A lamp unit having an electromechanical ball including first and second electrically-conductive hemispheres separated by an insulator region, the ball being pop-fit insertable and removable anywhere along a guide track apparatus providing first and second oppositely-disposed conductor strips, the lamp unit being rotatable with respect to the conductor strips to provide on-off switching. The lamp unit-track combination provides the multiple capabilities of aiming and on-off switching, as well as lamp insertion and removal, while eliminating conventional fixturing.

34 Claims, 5 Drawing Sheets

MINIATURE LIGHTING APPARATUS

BACKGROUND OF THE INVENTION

1. Field of the Invention

The subject invention relates generally to lighting apparatus and, more particularly, to micro-miniature lighting apparatus which provides easy and flexible adjustment of lighting direction while eliminating mechanical parts typically associated with directional lamp adjustment and on-off light-switching functions.

2. Description of Related Art

Presently, in the advertising industry, emphasis is being placed on point-of-purchase advertising located in retail outlets such as grocery stores and various other retail establishments. Generally, an effort is being made to render such point-of-purchase displays more attractive so as to promote sales while the consumer is in the store. The inventors have recognized that improved microminiature lighting could readily enhance the attractiveness of point-of-purchase displays, for example, by implementing "welcoming" lighting which comes on gradually as customers approach a particular display.

Typical lighting applications employ lamps with associated fixturing. Typically, the lamps mechanically interlock with the fixtures, for example, by a screw-in connection, or by means of prongs which plug into a cooperating female receptacle. Variable positioning or "aiming" of lighting is provided by mechanisms employing complex mechanical interconnection such as conventional "track" lighting. On-off lamp switching is similarly achieved conventionally by mechanisms of considerable mechanical complexity.

OBJECTS AND SUMMARY OF THE INVENTION

It is therefore an object of the invention to improve lighting apparatus;

It is another object of the invention to improve miniature lighting apparatus;

It is yet another object of the invention to provide miniature lighting apparatus particularly suited to point-of-purchase displays;

It is a further object of the invention to simplify lighting apparatus;

It is another object of the invention to provide lighting apparatus suitable for miniature track lighting applications;

It is another object of the invention to provide such improved lighting apparatus adaptable to numerous lighting apparatus support structures and various types of conventional individual lamps;

It is another object of the invention to provide improved lighting apparatus which eliminates conventional electromechanical connection between lighting fixtures and the lamps they mount;

It is another object of the invention to provide lighting apparatus which eliminates conventional on-off electromechanical switches; and It is another object of the invention to provide lighting apparatus which provides microminiaturization in a wide variety of applications, while at the same time achieving high performance and low cost.

These objects and advantages are achieved according to the invention by providing a lamp unit mounting receptacle and a cooperating lamp unit. The structure of the cooperating lamp unit and receptacle permit pop-in insertion and removal of lamp units at any desired position and the capability to turn the lamp units on or off by merely turning them manually or otherwise manually changing the position of the lamp unit with respect to the receptacle or housing. The direction of illumination provided by the lamp units is also changed by simply manually pointing the lamp units in the desired direction. The invention contemplates the provision of lamp units directly pluggable into and removable from a mounting track with the entire elimination of cumbersome intervening fixturing.

According to one feature in accordance with the invention, an electromechanical ball conductor element is provided in the form of a separate, subminiature "lighting fixture," into which a conventional lamp unit inserts. The combined structure of the fixture and lamp provides the multiple capabilities of aiming and on/off switching, as well as lamp insertion and removal. A second feature according to the invention is the further combining of the ball fixture and the lamp element into a single integral unit. Thus, the ball conductor element effectively becomes an integral "base" for a modified conventional lamp. According to this second aspect of the invention, the "lighting fixture" is eliminated and the structure reduced in complexity to just the ball-fitted lamp and its mounting track.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide easily usable, readily manufacturable, and low-cost lighting apparatus.

Figure 1:
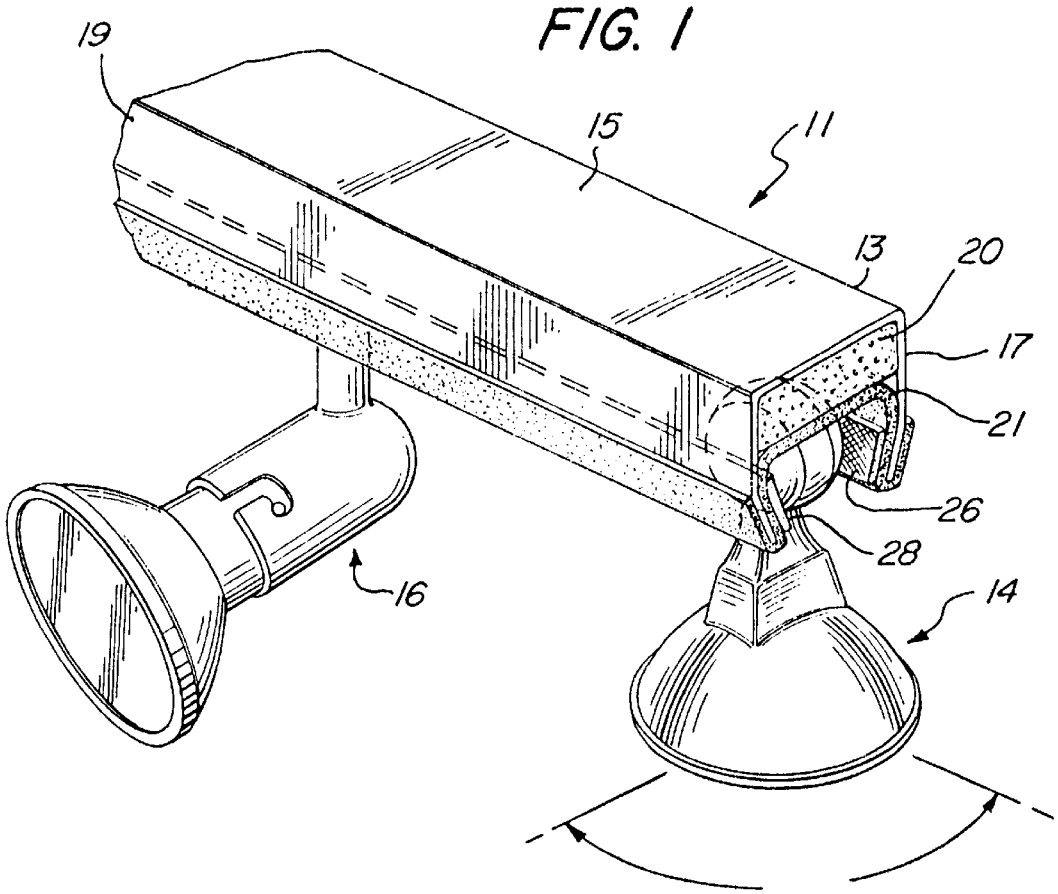
FIG. 1 is a perspective view illustrating apparatus according to the preferred embodiment of the invention.

FIG. 1 illustrates a lighting apparatus 11 according to the preferred embodiment. This apparatus 11 includes a track 13 for mounting one or more lamp units, e.g., 14, 16. As will be further described, mounting track 13 and lamp units, e.g., 14 and 16, are constructed such that the lamp units 14, 16 are pluggably insertable directly into and out of the mounting track 13.

Figure 2:
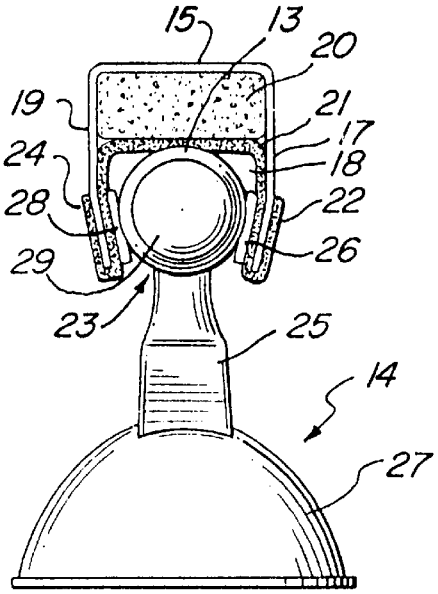
FIG. 2 is an end view of apparatus according to the preferred embodiment of the invention.

As shown in FIG. 2, the mounting track 13 includes a generally flat planar top surface 15 having integrally-formed sides 17, 19 depending therefrom so as to generally define a channel 18 therebetween. The track 13 in a prototype embodiment is formed of 24 gauge aluminum sheet which is bent at two locations to define the sides 17, 19. Other materials such as lighter gauge "spring steel" or resilient plastic may be used to provide extra lamp-holding capability.

A spacer 20 of rectangular cross-section is glued or otherwise positioned in the upper portion of the channel 18, and is mounted flush against the underside of the top surface 15 of the track 13. The spacer 20 may be fabricated of a foam insulating material such as neoprene or silicone. The sides 17, 19 curve gently inward and exhibit a resilient bias which normally maintains them in a selected position.

A resilient foam layer 21 is mounted within the channel 18 formed by the sides 17, 19. As shown, the layer 21 includes respective end portions 22, 24 which wrap around and are preferably attached, for example, by gluing to the ends of each respective side 17, 19. The layer 21 shown in FIG. 2 generally has a cross-section generally defined by the metal channel and resembling the Greek letter "omega."

As further shown in FIG. 2, a light unit 14 is rotatably mounted in the channel 18 provided by track 13. The light unit 14 generally includes a reflector lamp portion 27 and a stem 25 of rigid insulation material which forms a portion of an electromechanical ball 23. The ball 23 provides the rotational interface with the track 13.

As illustrated in FIGS. 1 and 2, respective conductors 26, 28 are attached to the respective interior side walls of the resilient layer 21. The conductors 26, 28 typically extend the length of the track 13 and are disposed opposite one another on the walls of the layer 21. In a prototype embodiment, the oppositely-disposed conductors 26, 28 are fabricated of flexible braided flat, 10 gauge wire, such as, for example, Part No. 300-31, 10-gauge copper flexible braid per Federal Specification QQ-B-575 as available from the Standard Wire and Cable Company, Rancho Dominguez, Calif. 90220. In the same embodiment, the layer 21 is fabricated of medium-density resilient neoprene foam sheet with the flexible braided conductors 26, 28 glued on, rather than mechanically retained. Various other resilient materials can be cut or extruded and variously fixed in place to create layer 21.

Figure 3:
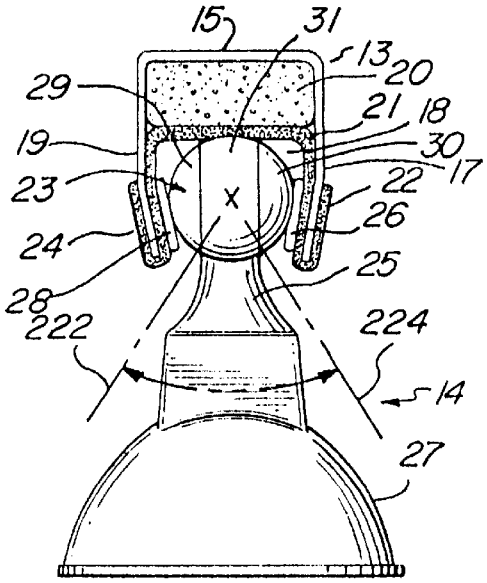
FIG. 3 is a side view of a lamp unit according to the preferred embodiment of the invention.

FIG. 3 illustrates the lamp unit 14 rotated 90 degrees about its vertical axis from its position in FIG. 2. In this position, it may be seen that the insulating stem 25 extends upward and is configured to conform to and mount with the hemispherical interior surface of the hemispherical conductor contacts 29, 30. This construction results in a visible circular stripe 31 of rigid insulator material 25 separating the two conductive hemispheres 29, 30. Assuming the electromechanical ball 23 is in the position shown in FIG. 3 and a suitable voltage is applied to the conductors 26, 28, the lamp 27 is lit, i.e., it is in the "on" condition. When the electromechanical ball 23 of FIG. 3 is manually rotated to the position shown in FIG. 2, electrical contact with the oppositely-disposed conductors 26, 28 is broken and the lamp 27 is therefore not energized and is in the "off" state. Thus, lamp unit means according to the invention are energized merely by adjusting their position with respect to the cooperating retaining structure and conductors therein.

It will also be appreciated that lamps according to the preferred embodiments also possess aimability. Thus, for example, in FIG. 3, the vertical axis of the lamp unit 14 may pivot to the position indicated by dashed lines 222, 224 or to any point along the arc between those lines. With the vertical axis pivoted to line 222, the lamp unit may be rotated 360 degrees such that line 222 traverses the surface of a cone. Such a rotation may be achieved through any line along the arc of aimability defined between the vertical axis and line 222.

Figure 4:
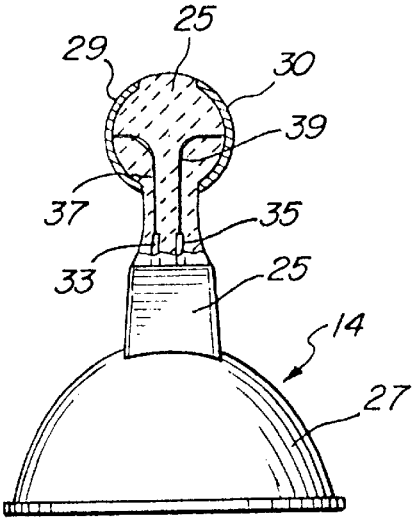
FIG. 4 is a partial cross-sectional view of the embodiment of FIG. 3.

FIG. 4 illustrates a cross-section of the lamp unit 14 of FIG. 3. First and second conductors 37, 39 provide respective electrical conductive paths from plug-type contacts 33, 35 of a conventional lamp unit to the conductive hemispheres 29, 30. As may be seen, the conductors 37, 39 are embedded in the rigid insulator material 25 which, as already noted, electrically separates and insulates the hemispheres 29, 30 from one another. The rigid insulator material 25 used in the aforementioned prototype embodiment is epoxy. However, it may be any other suitable ceramic, glass, or other insulative or dielectric material. The rigid insulator material 25 may be applied and formed into its shape by hand or by other conventional molding techniques.

The hemispherical conductor contacts 29, 30 of a prototype unit were formed of sections of brass half-balls soldered to short wire leads that connected to the pins of an MR-11 lamp or to the contacts of a bayonet socket. End plug contacts 33, 35 or their equivalent may be provided by many conventional lighting units such as MR-11, MR-16, and various other halogen units such as Model AR-48 and the T-3 and T-4 halogen display lamps and other lamps where directionality is desirable.

While a rigid insulator 25 is employed in various embodiments under discussion, resilience could be built into the insulator structure of an equivalent embodiment, for example, by building a resilience factor into a high temperature rubber or using other "springy" materials. The resilience provided by the resulting ball structure would offset, to a selected extent, the resilience required to be provided by the cooperating channel structure.

Figure 5:
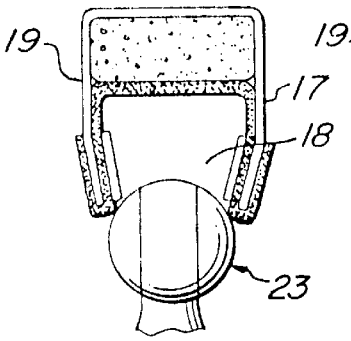
FIGS. 5–7 are cross-sectional schematic drawings illustrating insertion of a lamp unit according to the preferred embodiment.
Figure 6:
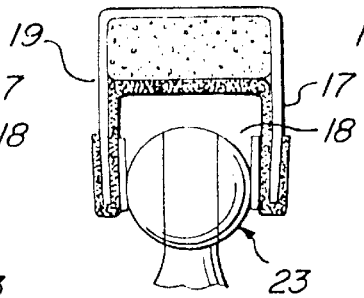
Figure 7:
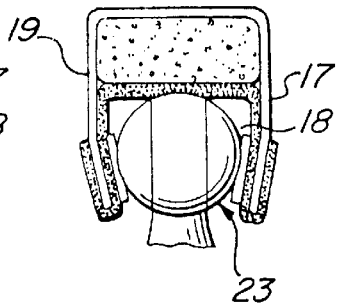

FIGS. 5–7 illustrate the manner of inserting and removing one or more lamp units, e.g., 14, 16, as desired, anywhere along the track 13. As shown, the opening in the channel 18 is slightly smaller than the diameter of the electromechanical ball 23. For example, the opening may be ¼-inch across, while the ball 23 is ½-inch in diameter. Thus, as the ball 23 is forced into the foam-lined sides 17, 19; the sides 17, 19 are spread apart against their resilient bias (FIG. 6). The ball 23 then snaps snugly into the channel 18 in a position in which it is gripped and cannot be easily pulled out, but in which it rotates freely for maximum flexibility in positioning or aiming the lamp units, e.g., 14, 16. If lamp removal is desired, the lamp unit, e.g., 14, is gripped and sufficient downward force manually applied to pull the lamp unit 14 out of the channel 18.

In the embodiment under discussion, the resiliency of both the foam and channel materials operates to receive and retain the ball 23. In other embodiments, the foam layer 21 may be avoided by providing a channel 18 formed of an elastomer or other material with sufficient resiliency and memory to achieve the desired results.

Figure 8:
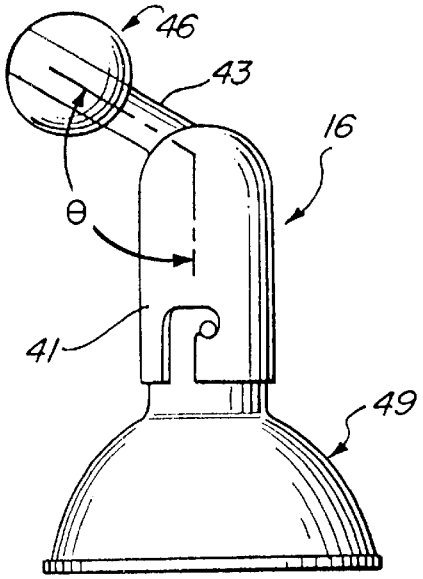
FIG. 8 is an elevational view of an alternative lamp unit according to the preferred embodiment.
Figure 15:
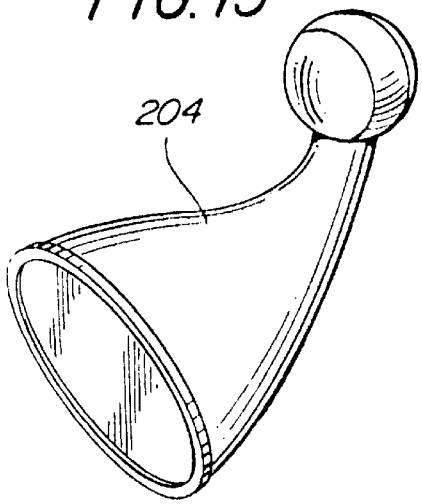
FIG. 15 is a perspective view of an alternate lamp unit embodiment.

The lamp unit 16 comprises an independent fixture and is shown in more detail in FIG. 8. As there shown, a rigid insulator extension arm 43 positions or "offsets" an electromechanical ball 46 at an obtuse angle θ to the vertical axis of generally cylindrical conventional lamp fixture 41. The fixture 41 mounts a conventional lamp unit 49 in turn-and-release fashion, i.e., a bayonet mount. The obtuse angle θ may be, for example, 120 degrees, and the length of the extension of the ball 46 on the order of one inch, yielding enhanced flexibility in positioning or aiming the lamp unit 16. This "offset" feature could, of course, be incorporated into a one-piece integral lamp unit, an example of which is illustrated in FIG. 15. The electromechanical ball 46 may be constructed identically to ball 23 of FIGS. 2 and 3.

Figure 9:
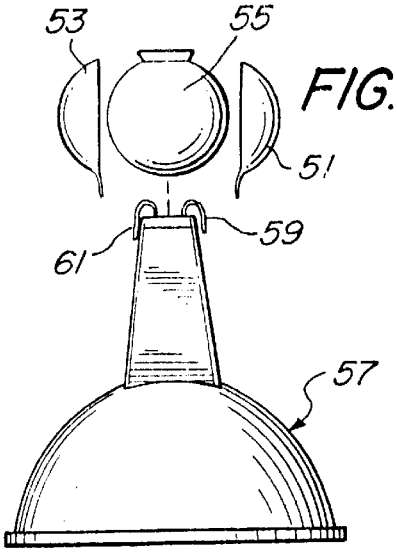
FIGS. 9 and 10 illustrate an alternative lighting unit embodiment construction according to the preferred embodiment.
Figure 10:
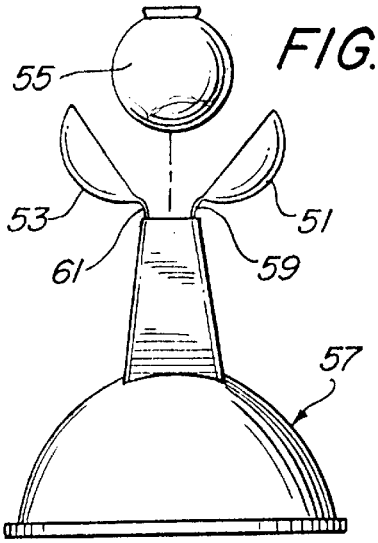

FIG. 9 illustrates a lamp embodiment in which a generally spherical insulator ball 55 is constructed with an interior opening designed to be plug-fitted, glued, or fused onto a lamp unit 57. The structure of FIG. 9 includes conductor wires 59, 61 and conductive hemispheres 51, 53. As shown in FIG. 10, the conductor wires 59, 61 are respectively welded onto the conductive hemispheres 51, 53. Thereafter, the insulator ball 55 is attached to the neck of the lamp 57 with the wires 59, 61 recessing in respective grooves (not shown) on either side of the ball 55. The conductive hemispheres 51, 53 are then attached to the sides of the ball 55. FIGS. 9 and 10 also illustrate a hat portion 58 on the ball. This element 58 is illustrative of a mechanism which could be provided in some embodiments to catch either of the oppositely-disposed conductors in order to prevent the lamp units from being popped out in response to hyper rotation, e.g., rotation beyond the axis of aimability.

Figure 11:
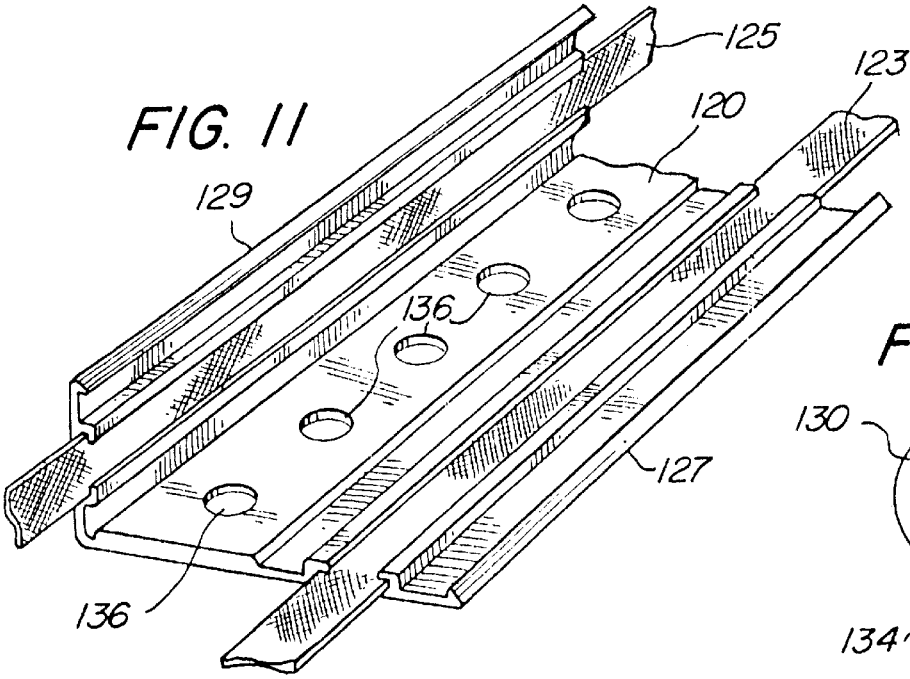
FIG. 11 illustrates an alternate track embodiment according to the preferred embodiment.

FIG. 11 illustrates an alternative mounting track for lamp units such as 14, 16 in which the lamp units pop-fit into suitably-sized apertures or holes 136 in a horizontal track member 120. The track member 120 is suspended by first and second side channel arms 127, 129. The first side channel arm 127 is shown in a "bent-out" position for illustrative purposes, but normally would be mounted at a 90-degree angle to the plane of the track 120 and parallel to the side channel arm 129. Electro-mechanical balls, e.g., 23 (FIG. 2) interface with the parallel wire braided conductors 123, 125 in the same manner as the embodiment of FIGS. 1 and 2.

FIG. 11 thus illustrates a structure wherein holes 136 in an elastomeric extrusion serve to provide additional lamp retention. A number of track sections 120 may be adapted to snap together into a tubular shape with holes 136 for lamps distributed along the length.

Figure 12:
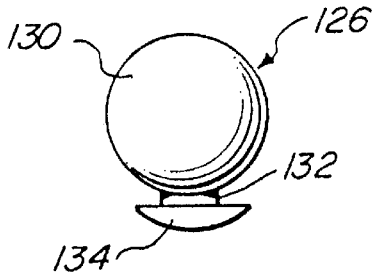
FIG. 12 illustrates dummy ball apparatus employable with various embodiments.

In order to facilitate bending of a track member such as track member 120 without jeopardizing the conductors 123, 125, "dummy" insulator balls 126 such as shown in FIG. 12 may be provided. The dummy ball 126 includes a sphere 130 formed of insulator material, a stem 132, and a cap 134. The cap 134 facilitates gripping, insertion, and removal of the dummy ball 126. Such balls 126 are located in each hole 136 of track 120 or similar track structures in an area where the track 120 is to be bent to a curved shape.

Figure 13:
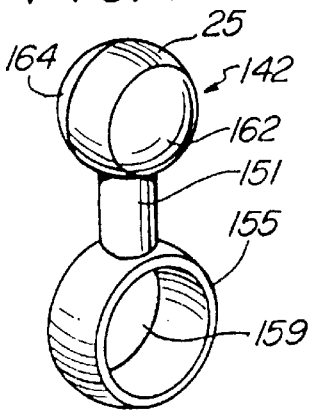
FIGS. 13–14 and 16–22 illustrate alternative lamp unit mounting apparatus according to the preferred embodiment.
Figure 14:
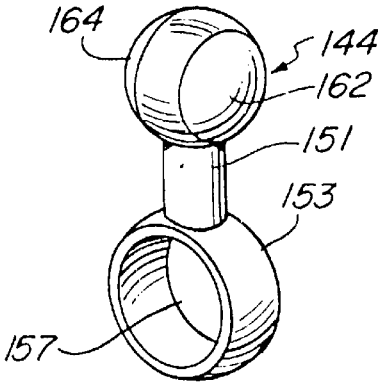

FIGS. 13 and 14 illustrate embodiments 142, 144 of a "peanut" accessory providing additional aiming capability. The accessory 142 of FIG. 13 employs an electromechanical ball like ball 23 of FIGS. 1 and 2. The insulator material 25 forms into an exterior arm 151 from which depends a socket 155 having an opening 159 therein. The opening 159 contains suitable conductors for establishing electrical connection to the electromechanical ball of a lamp unit such as lamp unit 14 of FIG. 1 and is shaped interiorly to provide rotational positioning and on/off switching of the lamp unit. Suitable electrical connections within the insulator material 25 provide electrical interconnection from the respective hemispheres 17, 19 of a lamp unit, e.g., 14, to respective conductive hemispheres 162, 164. The accessory 144 of FIG. 14 may be constructed identically to accessory 142 of FIG. 13 with the exception that the socket 153 and its opening 157 are rotated 90 degrees from the position of the socket 155 and opening 159 of FIG. 13.

Figure 16:
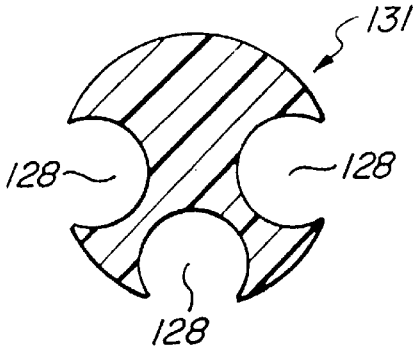
Figure 17:
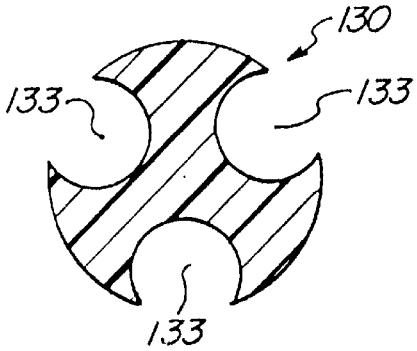

FIG. 16 schematically illustrates in cross-section another support track 131 structure in which electromechanical balls rotatably snap-fit into suitable mounting holes 128 along its length. FIG. 17 illustrates a similar cross-sectional structure 130 having mounting receptacles 133 for electromechanical balls 23.

Figure 19:
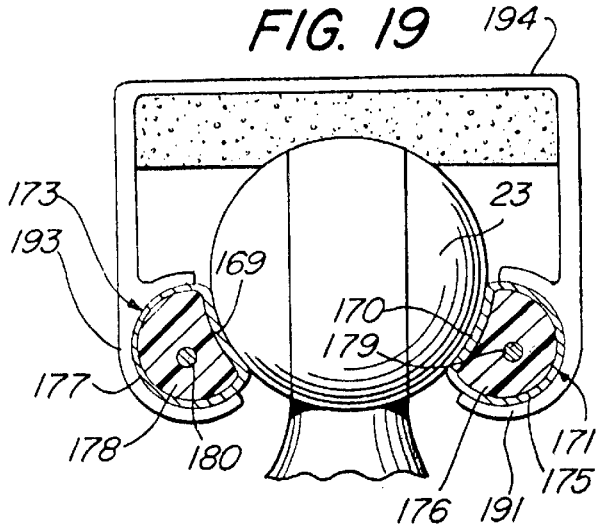

FIG. 19 particularly illustrates an alternate manner for providing electricity to an electromechanical ball 23 using conductor structures 171, 173 providing arcuate surfaces 169, 170 for mating with the ball 23. Each conductor 171, 173 may comprise a respective outer 12-volt conductor 175, 177, respective elastomeric foam insulator layers 176, 178 encased by the outer conductors 175, 177, and a respective 120-volt centrally-located inner conductor wire 179, 180. Each conductor 171, 173 thus comprises a coaxial structure. The elastomeric insulator portion 176, 178 facilitates snapping the coaxial structures into relatively rigid receptacles 191, 193 formed in a track member 194. The outer conductors 171, 173 may be formed of wire braid conductor. The 120-volt inner conductor 179, 180 may be used to power other circuitry such as 120- to 12-volt transformers located along the track run, or provide other voltages for various other circuits.

Figure 20:
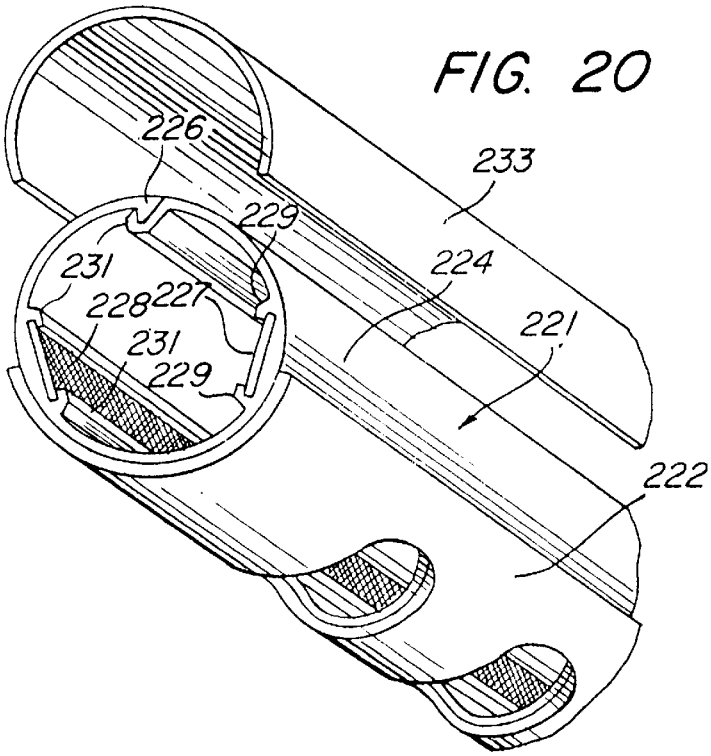

FIG. 20 illustrates another track embodiment wherein a track unit 221 has a cylindrical or pipe shape. An anterior cylindrical section 222 includes suitable openings 223 for receiving electromechanical balls, e.g. 23, 46 in pop-fit fashion. To this end, section 222 is preferably a medium to medium hard density elastomer or other material selected to lend sufficient resilience to the holes 223 that they dilate to receive a ball, e.g., 23 and then return to position to retain the ball. The cylindrical section 222 is shown attached to a plastic tube 224, but could be integrally formed as a single tubular extrusion.

The plastic tube 224 is shown in the "assembled" state in FIG. 20. The tube 224 is made of relatively flexible plastic sheet and provided with a hook-and-catch fastening mechanism including a hook portion 225 and catch portion 226 at opposite side edges of the sheet. The hook 225 and catch 226 may be of uniform cross-section down the length of tube 224. When unhooked, the tube 224 opens up so that each side lays out, similar to the position in which side channel arm 127 is illustrated in FIG. 11. In such position, installation of the respective oppositely-disposed conductors 227, 228 within receiving arms 229, 231 is readily accomplished. If desired, a snap-on tubular retainer 233, preferably of plastic or metal, may be provided to further secure the tube 224 in the assembled position shown in FIG. 20.

Figure 18:
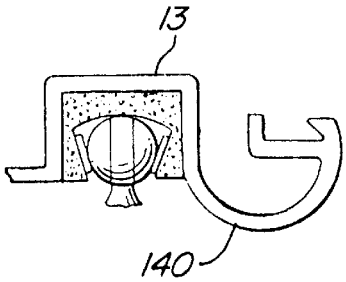
Figure 21:
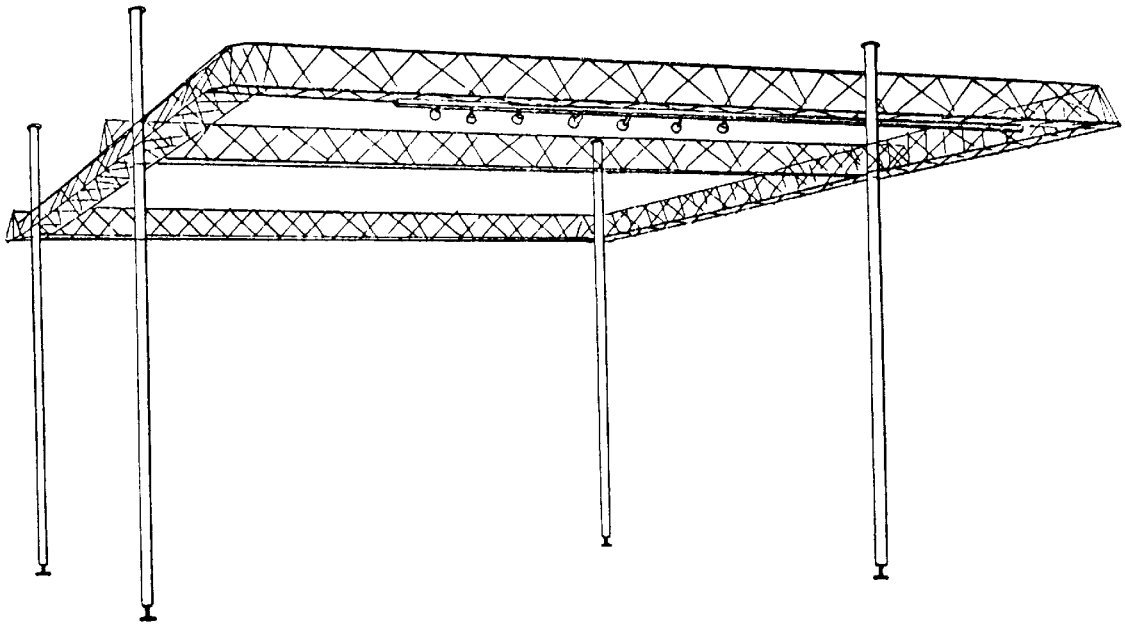
Figure 22:
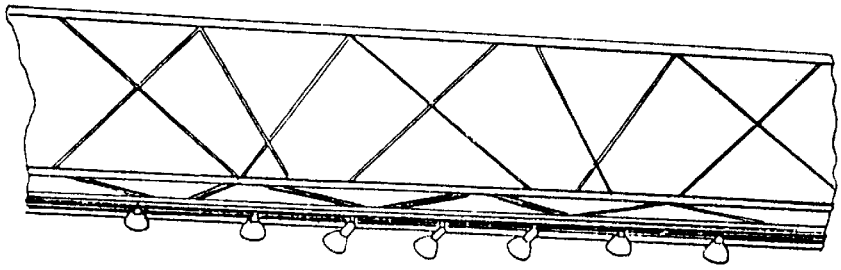

Those skilled in the art will appreciate the great variety of mounting mechanisms and adaptations for apparatus constructed according to the invention which are readily apparent from the above-described embodiments. FIG. 18 illustrates one example in which a track unit 13 is integrally mounted to an extension arm 140, which may be an aluminum extrusion forming the upper header of a display rack, wherein the foam track unit 141 occupies a ¾-in. by ¾-in. space, for example. Another example is an application to an overhead truss structure, such as shown in FIGS. 21 and 22, where cumbersome conventional track lighting units are replaced by suitably-configured lamp unit holders and lamp units according to the invention. Track apparatus such as track 13 may be conveniently bent and shaped by hand to meet various shaping requirements in sundry applications.

It will be observed that lighting apparatus according to the preferred embodiments provides great flexibility in the positioning of the lamp units within the track and the positioning of the track units themselves. Furthermore, lamps may be individually turned on and off by merely manually twisting or turning the lamp without the necessity for complicated on-off mechanisms, thus providing, for example, for the creation of different lighting effects from the same installation. Apparatus according to the invention is particularly suited for use with or deployment of various subminiature accessories such as lenses, filter holders, glare shields, decorative shrouds, etc.

Figure 23:
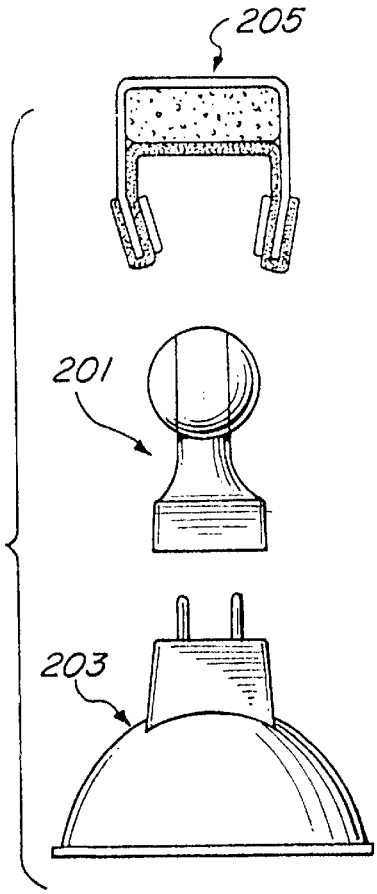
FIG. 23 is an exploded front view of one lamp unit embodiment according to the invention.

With reference to FIG. 23, it will be appreciated from the foregoing that one aspect of the invention provides an electromechanical ball conductor element 201 as a separate, subminiature "lighting fixture," into which a conventional lamp 203 inserts and rigidly attaches. The combined structure of fixture 201 and lamp 203 provides the multiple capabilities of aiming and on/off switching, as well as lamp insertion and removal. A second aspect according to the invention is the further combining of the ball fixture 201 and lamp element 203 into a single integral unit, for example, such as unit 204 shown in FIG. 15. In FIG. 15, the ball conductor fixture, e.g. 201, effectively becomes an integral "base" for a modified conventional lamp. The end result is that the "lighting fixture" is eliminated and the structure reduced in complexity to just the ball-fitted lamp, e.g. 204, and its mounting track 205. While the foregoing discussion of the preferred embodiments has shown a ball or spherical shape as providing the electrical interface with various lamp unit receptacle means, a cylindrical-shaped element could also provide this interface, although with reduced-aiming flexibility.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Lighting apparatus comprising:

a lamp unit receptacle means having first and second electrical conductor means mounted therein and spaced apart from each other; and lamp unit means for providing illumination, said lamp unit means being manually pluggable into and manually removable entirely out of said receptacle means said lamp unit means further having conductor means thereon rotatable within said receptacle means with respect to said first and second electrical conductor means while said lamp unit means is plugged into said receptacle means for alternately switching said illumination "on" and "off" in response to manual adjustment of a position of said lamp unit means with respect to said first and second conductor means.

2. The lighting apparatus of claim 1 wherein said adjustment comprises a rotation of said lamp unit means not exceeding 90 degrees.

3. The lighting apparatus of claim 1 wherein said lamp unit means is further rotatable within said receptacle means for aiming the illumination therefrom in a desired direction.

4. The lighting apparatus of claim 3 wherein said aiming covers an arc of aimability and a 360-degree rotation of that arc.

5. The lighting apparatus of claim 1 wherein said lamp unit receptacle means comprises:

first and second sides forming a channel therebetween;

a resilient foam layer lining said channel;

a first conductor strip attached to said first side down the length thereof; and a second conductor strip attached to said second side down the length thereof.

6. The lighting apparatus of claim 5 wherein said first and second sides extend inwardly toward one another and exhibit a second resilient bias tending to maintain them in a selected position.

7. The lighting apparatus of claim 6 wherein said resilient foam layer is wrapped about said first and second sides so as to take on a cross-sectional shape conforming generally to a shape of a Greek letter "omega."

8. The apparatus of claim 7 wherein said first and second conductors each comprise flexible wire braid conductors.

9. The lighting apparatus of claim 5 wherein said lamp unit means includes a spherical ball portion comprising a first conductive region, a second conductive region, and an insulator region separating said first and second conductive regions, said spherical ball portion sized to be pop-fit insertable into and out of said channel at a plurality of selected positions along a length of the channel.

10. The lighting apparatus of claim 1 wherein said receptacle means comprises:

first and second oppositely-disposed coaxial structures, each structure having an outer conductive skin, a central insulator portion within said conductive skin, and a conductor located within said central insulator portion.

11. The lighting apparatus of claim 10 wherein said insulator portion comprises a resilient material.

12. The lighting apparatus of claim 11 wherein said skin comprises wire braid.

13. The lighting apparatus of claim 10 wherein said lamp unit means includes a spherical ball portion comprising a first conductive region, a second conductive region, and an insulator region separating said first and second conductive regions.

14. The lighting apparatus of claim 1 where said receptacle means comprises:

a channel means having first and second sides and a bottom portion having means therein for pop-fit receiving one or more of said lamp unit means.

15. The lighting apparatus of claim 14 wherein said lamp unit means includes a spherical ball portion comprising a first conductive region, a second conductive region, and an insulator region separating said first and second conductive regions, said spherical ball portion sized to be pop-fit insertable into and out of said means for pop-fit receiving.

16. The lighting apparatus of claim 1 wherein said receptacle means comprises:

a flexible sheet means having first and second edges and first and second electrical conductors laid out opposite one another along the length of said flexible sheet means;

receptacle means for at least one said light unit located between said first and second conductors; and means for interconnecting said first edge with said second edge for forming said sheet into a tubular shape, said first and second conductors being positioned to lie disposed opposite one another with said receptacle means located therebetween when said sheet is in said tubular shape.

17. The lighting apparatus of claim 16 further including a snap-on retainer tube section means for further retaining said sheet in said tubular shape.

18. The lighting apparatus of claim 16 wherein said lamp unit means includes a spherical ball portion comprising a first conductive region, a second conductive region, and an insulator region separating said first and second conductive regions, said ball portion sized to be pop-fit insertable into and out of said receptacle means.

19. Lighting apparatus comprising:

an electromechanical spherical ball having first and second conductive portions separated by an insulator portion, said conductive portions each having an outer surface which is a section of a sphere;

an electrically-activated lamp having first and second electrical interconnections to said first and second conductive portions, respectively; and a receptacle for receiving said electromechanical ball and having first and second conductors positioned therein to establish an electrical conductive path with said first and second conductive portions when said ball is in a first position with respect to said receptacle and to break said path when said ball is in a second position with respect to said receptacle.

20. The lighting apparatus of claim 19 wherein said receptacle is shaped to permit rotation of said ball with respect thereto.

21. The lighting apparatus of claim 20 wherein said first position comprises a 90-degree rotation from said second position.

22. Lighting apparatus comprising:

a lamp unit receptacle means having first and second electrical conductor means mounted therein and spaced apart from each other;

lamp unit means for providing illumination and having a spherical end portion said end portion being pop-fit pluggable into and removable from said receptacle means and rotatable about a plurality of axes within said receptacle means with respect to said first and second electrical conductor means for alternately switching said illumination "on" and "off" by manual adjustment of a position of said lamp unit means with respect to said first and second conductor means.

23. The lighting apparatus of claim 22 wherein said lamp unit means comprise a lamp having a rim at an end opposite said spherical end portion and wherein said manual adjustment is accomplished in part by grasping said opposite end about said rim.

24. A lamp unit comprising:

an electrically-activated lamp having first and second electrical contacts; and a fixture for receiving said lamp, said fixture having a spherical-shaped portion including a nonconductive stripe dividing first and second conductive regions, each of said first and second conductive regions being a surface which is a section of a sphere, said fixture further including electrical interface means located in said fixture for pluggably receiving said lamp and establishing electrical contact between said first and second contacts and said first and second conductive regions.

25. The lamp unit of claim 24 wherein said spherical-shaped portion is located at a first end of said lamp and wherein said lamp includes a rimmed reflector at a second end opposite said first end.

26. A lamp unit comprising:

electrically-activated lamp means for providing illumination in response to an electrical signal; and means integrally formed with said lamp means and including a spherically-shaped member having an axis and an insulator region separating first and second electrically-conductive regions, each of said conductive regions having a surface which is a section of a sphere for rotation of the spherically-shaped member about the axis to selectively connect the lamp means for receiving said electrical signal and supplying it to said lamp means to thereby activate said lamp means and for rotation of the spherically-shaped member so as to pivot the axis to selected positions for aiming the connected lamp unit.

27. The lamp unit of claim 26 wherein said spherical-shaped portion is located at a first end of said lamp unit and wherein said lamp unit includes a rimmed reflector at a second end opposite said first end.

28. For use in conjunction with a lamp unit having a first spherically-shaped electromechanical ball associated therewith, said first ball including first and second conductive spherical regions separated by an insulator region, the apparatus comprising:

a second spherically-shaped electromechanical ball having first and second conductive regions separated by an insulator region;

an arm depending from said second ball;

a receptacle means for receiving and retaining said first ball attached to said arm; and conductor means in said receptacle means and said second ball and operative when said first ball is present in said receptacle means in a selected orientation with respect thereto for establishing an electrically conductive path between the first conductive region of said first ball and the first conductive region of said second ball and between the second conductive region of said first ball and the second conductive region of said second ball.

29. Lighting apparatus comprising:

a lamp unit receptacle means having first and second electrical conductor means mounted therein and spaced apart from each other;

lamp unit means for providing illumination, said lamp unit means being pluggable into and removable from said receptacle means and rotatable within said receptacle means with respect to said first and second conductor means for providing illumination and for alternately switching said illumination "on" and "off" in response to manual adjustment of a position of said lamp unit means with respect to said first and second conductor means; and wherein said receptacle lamp unit means further includes a channel means having first and second sides to which said first and second electrical conductor means are respectively attached and a bottom portion including means for pop-fit receiving one or more of said lamp unit means.

30. The lighting apparatus of claim 29 wherein said lamp unit means is further rotatable within said receptacle means for aiming the illumination therefrom in a desired direction and wherein said aiming covers an arc of aimability and a 360-degree rotation of that arc.

31. The lighting apparatus of claim 29 wherein said first and second sides extend inwardly toward one another and exhibit a resilient bias tending to maintain them in a selected position.

32. The lighting apparatus of claim 29 wherein said lamp unit means includes a spherical ball portion comprising a first conductive region, a second conductive region, and an insulator region separating said first and second conductive regions, said ball portion sized to be pop-fit insertable into and out of said channel at a plurality of selected positions along a length of the channel.

33. The lighting apparatus of claim 31 wherein said lamp unit means includes a spherical ball portion comprising a first conductive region, a second conductive region, and an insulator region separating said first and second conductive regions, said ball portion sized to be pop-fit insertable into and out of said channel at a plurality of selected positions along a length of the channel.

34. Lighting apparatus comprising:

a lamp unit receptacle means having first and second electrical conductor means mounted therein and spaced apart from each other; and lamp unit means for providing illumination, said lamp unit means being pluggable into and removable from said receptacle means and rotatable within said receptacle means with respect to said first and second conductor means for providing illumination and for alternately switching said illumination "on" and "off" in response to manual adjustment of a position of said lamp unit means with respect to said first and second conductor means, said lamp unit means further being rotatable within said receptacle means for aiming the illumination therefrom in a desired direction and wherein said aiming covers an arc of aimability and a 360-degree rotation of that arc.

* * * * *

UNITED STATES PATENT AND TRADEMARK OFFICE

CERTIFICATE OF CORRECTION

PATENT NO. : 6,170,967 B1
DATED : January 9, 2001
INVENTOR(S) : Scott Usher et al.

It is certified that error appears in the above-identified patent and that said Letters Patent is hereby corrected as shown below:

Title Page,

After "(76) Scott Usher, 98 Copley Ave., Teaneck, NJ (US) 07666; Terrence C. Walsh, 2 Whitehall, Coto de Caza, CA (US) 92679" insert the following:
-- (73) Assignee: Tivoli Industries, Inc., Santa Ana California 92705 --.

Signed and Sealed this

Ninth Day of October, 2001

*Attest:*

Nicholas P. Godici

*Attesting Officer*

NICHOLAS P. GODICI
*Acting Director of the United States Patent and Trademark Office*